United States Patent [19]

Showell et al.

[11] 3,961,831

[45] June 8, 1976

[54] STORAGE ASSEMBLIES

[75] Inventors: Richard Grahame Dugard Showell, Bishampton, near Pershore; Peter John Spears, Cropthorne, both of England

[73] Assignee: Bar Productions (Bromsgrove) Limited, Bromsgrove, England

[22] Filed: Mar. 18, 1975

[21] Appl. No.: 559,507

[30] Foreign Application Priority Data

Mar. 23, 1974 United Kingdom ..... 13266/74
Dec. 18, 1974 United Kingdom ..... 54742/74

[52] U.S. Cl. ..... 312/200; 312/198; 104/172 R; 246/182 B

[51] Int. Cl.[2] ..... A47B 53/02; B61J 3/04

[58] Field of Search ..... 312/198, 200, 201; 104/88, 162, 172; 246/182 B

[56] References Cited

UNITED STATES PATENTS

| | | | |
|---|---|---|---|
| 2,900,922 | 8/1959 | Edmonds | 104/162 |
| 3,200,767 | 8/1965 | Klamp et al. | 104/88 |
| 3,566,802 | 3/1971 | Lundgvist | 312/199 X |
| 3,665,864 | 5/1972 | Bildsoe | 104/88 |
| 3,724,389 | 4/1973 | Greaves | 104/162 |

*Primary Examiner*—Casmir A. Nunberg
*Attorney, Agent, or Firm*—Scrivener Parker Scrivener and Clarke

[57] ABSTRACT

Sensor means which is fitted to a mobile member so as to stop the latter on engagement with an object in its path comprising a trip bar, a plurality of links which are arranged at spaced points along the mobile member and are each pivotally connected to said mobile member and trip bar at respective opposite ends so that they form a folding parallelogram with the mobile member and trip bar, and switch means which is arranged in relation to said trip bar so as to be operated by movement of the latter towards said mobile member. Preferably, at least one of the links is pivotally connected to the mobile member by connection means which is adjustable in position along a respective portion of the length of the mobile member and which preferably carries a stop in a predetermined angular position relative to the pivot between the link and connection means so that the links lie parallel to one another when they engage their respective stops. Preferably, the sensor means is mounted with the trip bar extending horizontally along the base of a mobile storage unit.

19 Claims, 5 Drawing Figures

STORAGE ASSEMBLIES

Figure 2:
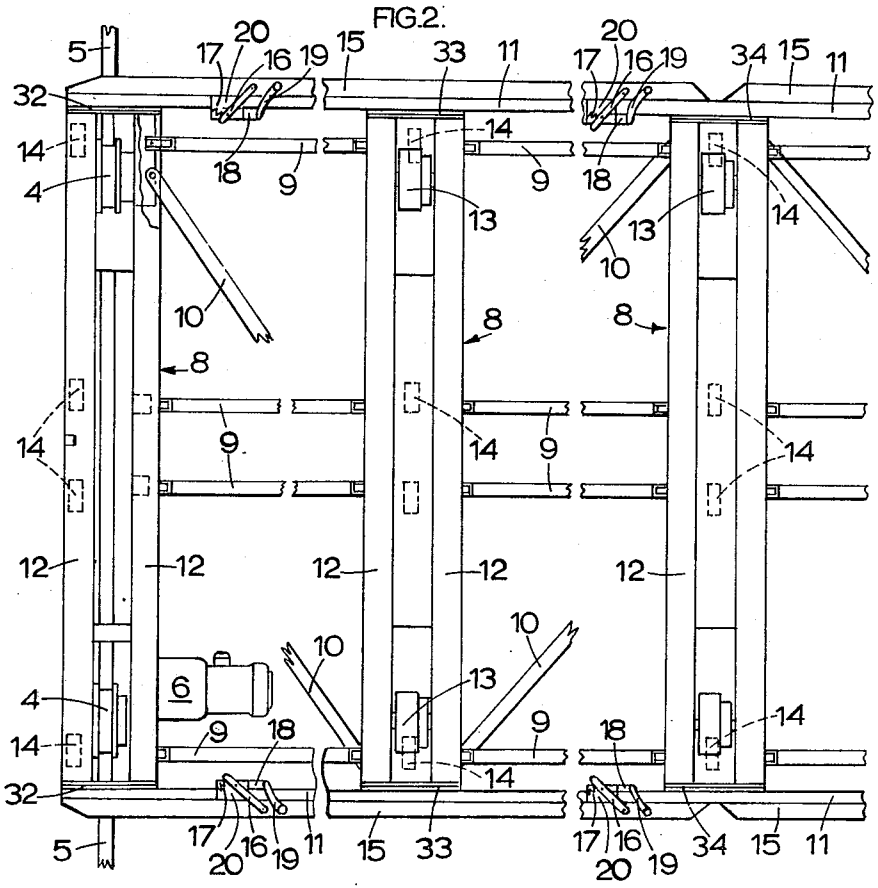

This invention relates to sensor means which is fitted to a mobile member so as to stop the latter moving on engagement with an object in its path. In particular, this invention relates to storage assemblies of the kind in which a row of storage units, such as racks, are movable along the length of the row in either of two opposite directions so that a gangway can be provided between any two adjacent units, and in which each movable storage unit is provided with sensor means to stop it closing on an adjacent unit if an object is present in the gangway between them.

Storage assemblies of this kind are known in which the sensor means comprise trip bars on the base of each movable storage unit along each side opposite the bases of adjacent units so that they engage adjacent trip bars or other obstructions in their path and move to operate switch means which stops movement of the storage unit. Thus, once movement of a storage unit is initiated, it continues until it closes on an adjacent storage member or meets an obstruction.

In one of these known storage assemblies, each trip bar is mounted on the base by a plurality of spring loaded plungers which are arranged along the length of the bar so as to allow horizontal movement of the bar against spring pressure towards the base, and each of which has a stop switch associated with it so as to be operated by the inner end of the plunger. The plungers allow horizontal movement of the whole of the bar and operate all of the stop switches when the bar engages an adjacent bar or an obstruction near its central portion. In fact operation of only one switch is sufficient to stop the respective storage unit, but if that switch or its associated circuitry is faulty the storage unit may not be stopped, whereupon there is a risk that the assembly may be damaged and persons may be hurt if they themselves constitute said obstruction.

An object of the present invention is to provide a storage assembly of the aforementioned kind having trip bars, each of which is supported so that it moves in the same manner irrespective of the region in which it is engaged by an obstruction.

This object is achieved according to the present invention by providing sensor means comprising a trip bar which is mounted on said mobile member by a plurality of links which are arranged at spaced points along the bar and are pivotally connected to said member and bar at respective opposite ends so that the axes of the pivotal connections are all parallel to one another and the links form a folding parallelogram with the mobile member and trip bar which constrains the trip bar to assume positions paralled to the mobile member as it swings on the links towards and away from the mobile member in a plane perpendicular to said pivotal axes. Thus, the bar moves in the same manner irrespective of the position of its point of engagement with an obstruction, and every one of a plurality of stop switches which may be positioned along the side of the mobile member will be operated each and every time the bar is moved towards the mobile member.

In order that the trip bar should move in said paralled manner, the pivot centres of the links must be accurately positioned so as to define said parallelogram. This can be achieved using a jig to form pivot holes at a fixed spacing in the trip bar and mobile member.

However, an improved method of mounting the trip bar on the mobile member consists in connecting all, or all but one, of the links to said mobile member via individual connection means which is adjustable in position along a respective part of the length of the mobile member so that the spacing of the pivot centres formed between the links and connection means can be adjusted at will to match the position of the pivot centres between the links and trip bars and thereby form the necessary parallelogram configuration. This mounting for the trip bar avoids the need for a separate manufacturing step to form pivot holes in the mobile member and also reduces the need for accurate positioning of the pivot holes in the trip bar. Further, the connection means need not require any modification to the mobile member which makes it handed and might limit its subsequent use in assembling it in a mobile structure.

Adjustment of the connection means relative to one another along the mobile member is facilitated by providing, on at least two of the connection means, stops which are accurately positioned in the same fixed orientation relative to the pivot centres between the respective links and said connection means so that the links lie parallel to one another when they engage the respective stops. Adjustment then simply requires that the connection means be positioned with the respective links engaging the stops. The trip bar is then in its forwardmost position and may be urged to this position by spring means.

The stop switches are preferably also mounted on the connection means so that nothing other than the connection means is connected to the mobile member and the latter is not modified in any special manner to carry the trip bar.

Preferably the trip bar lies in a different plane to the mobile member so that its rearwards movement is not hindered by the mobile member. In an arrangement in which the trip bar extends horizontally, it is preferably pivotally supported by the links beneath the mobile member. For example, each link may be connected to the lower end of a pivot pin supported by the connection means and may extend forwards beneath the mobile member and be connected to the trip bar at its outer end so that the trip bar can swing inwards beneath the mobile member. This arrangement possesses a number of different advantages. Firstly, the links are subject to minimum frictional forces and thus the trip bar responds to low operating forces which move it rearwardly. Secondly, the chances of any articles falling behind the trip bar and remaining there to block rearward movement are very slight. Thirdly, the vertical position of the trip bar can be adjusted and can be brought very close to ground level. This last advantage is particularly significant in the case of storage assemblies of the kind described above.

Preferably, each trip bar is mounted on the mobile member by a pair of parallel links so as to avoid possible binding or jamming which could result from the use of three or more links which are not truly parallel. However, it will be appreciated that three or more links may advantageously be employed to support a long trip bar.

Figure 1:
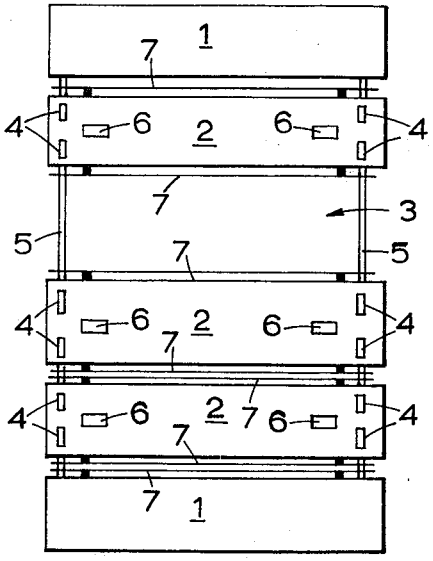
Figure 3:
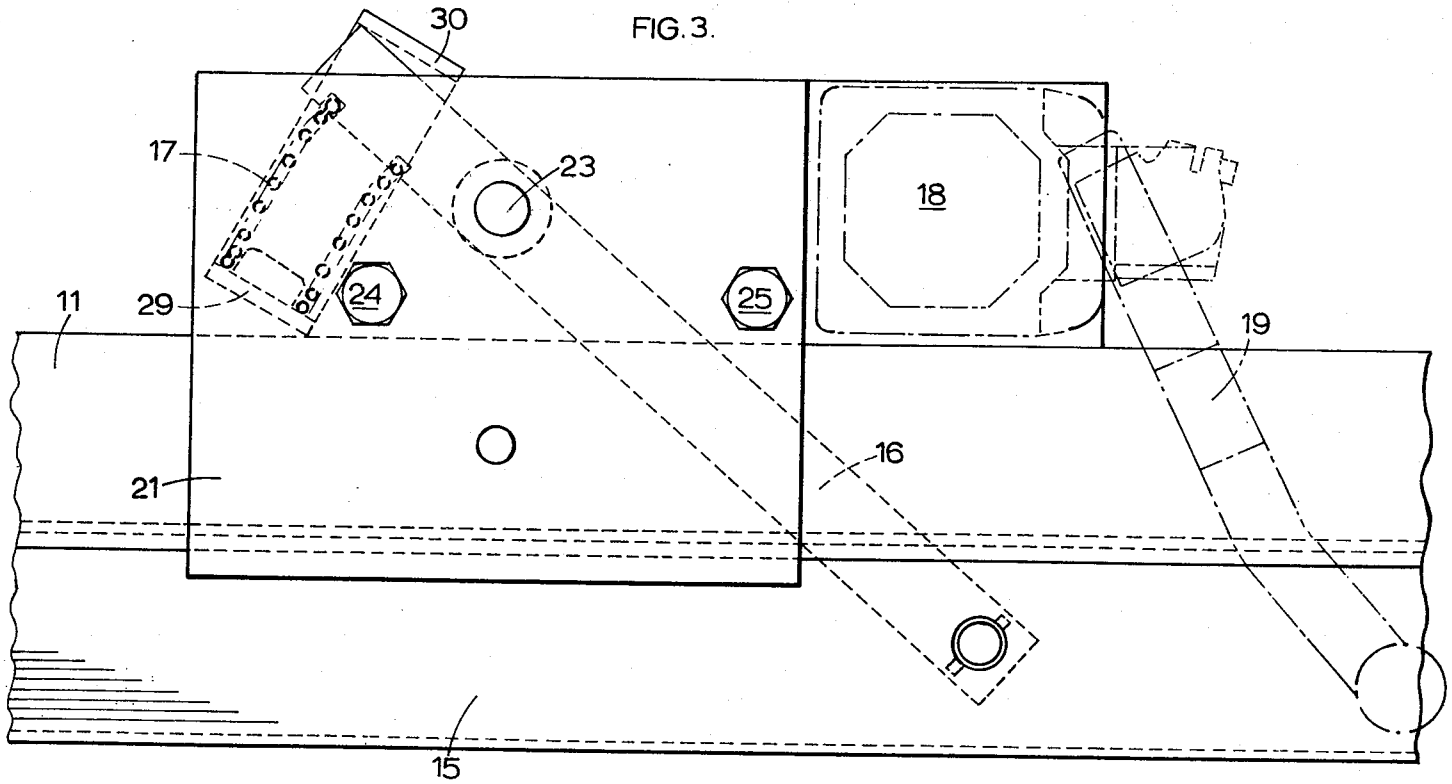
Figure 4:
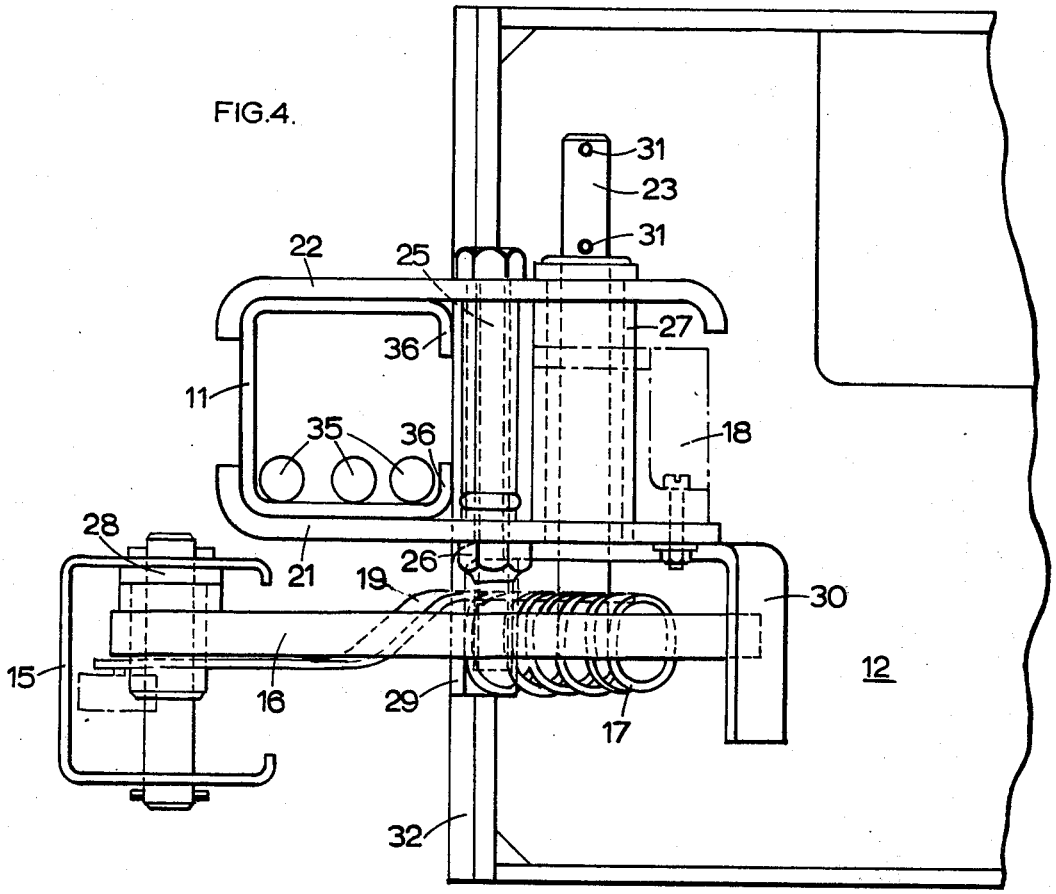
Figure 5:
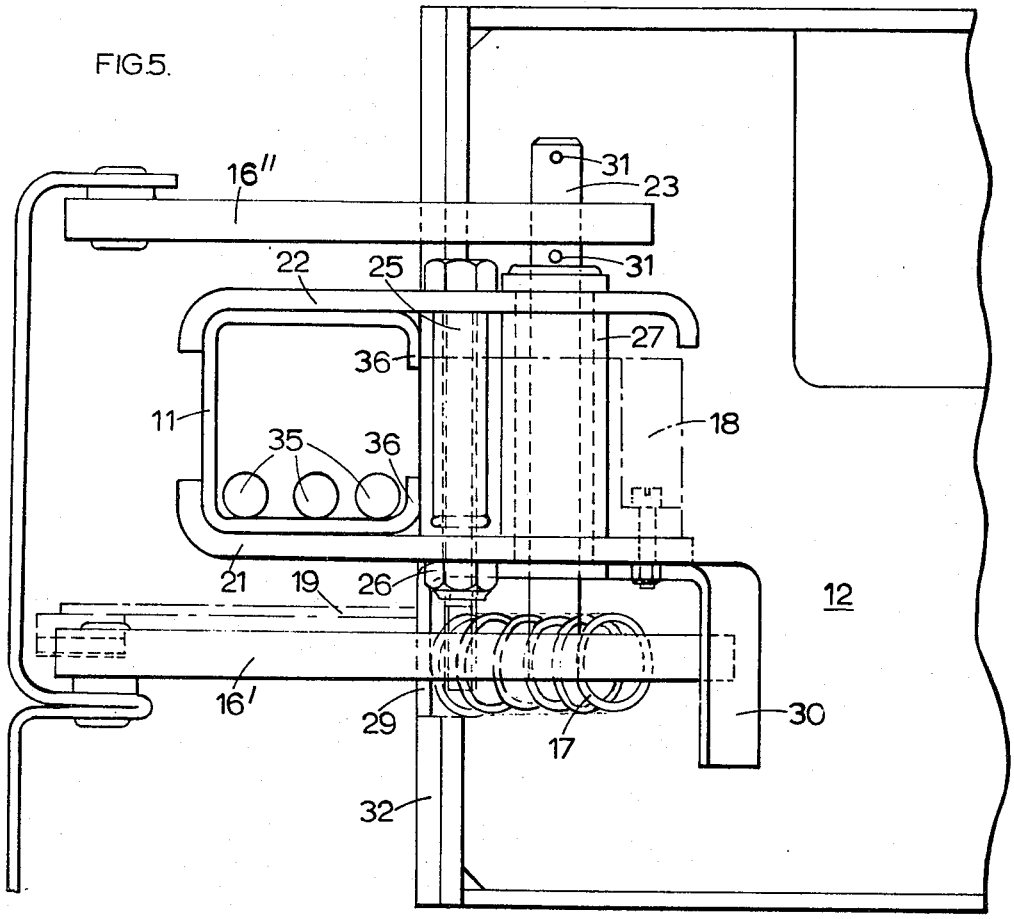

The invention will now be described by way of example with reference to the accompanying drawings in which:

FIG. 1 is a schematic plan view of a storage assembly including sensor means according to the invention, FIG. 2 is a plan view of part of a mobile base in the storage assembly of FIG. 1, FIG. 3 is a plan view of the sensor means of FIGS. 1 and 2 to an enlarged scale, FIG. 4 is a side elevation of the sensor means of FIG. 3, and FIG. 5 is a section through sensor means forming an alternative embodiment of the invention.

The storage assembly shown in FIG. 1 comprises a row of storage racks including two end racks 1 which are fixed and three intermediate racks 2 which are mounted on mobile bases so that they can be moved along the length of the row to open or close a gangway 3 between any two of the racks. The mobile bases each include a pair of wheels 4 at each end which run on a respective guide rail 5 set in the ground, and reversible electric motors 6 which drive the wheels 4. Each mobile base also carries sensor means 7 along each side opposite the adjacent base or rack so that it is operated by engagement with said adjacent base or rack or an object in the respective gangway and then serves to stop movement of the base.

The construction of each mobile base can be better understood from FIG. 2 which shows a plan view of the left-hand end of a base. The base comprises a framework of wheel supporting sections 8 which are connected by channel-section cross members 9 and tie bars 10 between adjacent sections 8, and sensor support members 11 which each span across, and are connected to, the ends of three neighbouring sections 8. Each section 8 includes a pair of channel-section members 12 which are connected back-to-back with a space therebetween for the wheels which are mounted in bearings in the webs of the channel-section members 12. The end sections 8 support the pair of wheels 4 which run on the respective guide rail 5, and each of the intermediate sections 8 supports a pair of ground engaging wheels 13. A reversible electric motor 6 is mounted on each end section 8 and drives one of the wheels 4 through suitable gearing, and a similar motor may be mounted on one or more of the intermediate sections 8 to drive one of the associated wheels 13. The rack 2 which is mounted on the base has upright members which are connected to the sections 8 at their lower ends in positions 14, as shown in broken lines in FIG. 2, each bay of the rack corresponding to the spacing between the sections 8. The upper side flanges of the channel-section members 12 and the uppermost web of the cross members 9 all lie in the same horizontal plane which thereby defines the lowermost shelf of the rack.

Each sensor means 7 comprises a series of trip bars 15 which are mounted on the respective support bars 11 so as to extend end-to-end along the whole side of the base parallel with the support members 11. The trip bars on all of the mobile bases lie in substantially the same horizontal plane so that the trip bars on adjacent bases engage one another as the bases come together. Each trip bar 15 is mounted on a respective support member 11 by a pair of equi-length parallel links 16 such that the centres of the pivotal connections of the links to the support member and trip bar at respective opposite ends define a parallelogram, whereby the trip bar is constrained to assume positions parallel to the support member as it swings on the links towards and away from the support member. A spring 17 acts on each link 16 to urge the trip bar away from the support member to a forwardmost position, and an electrical sensor switch 18 is associated with each link 16 and has an operating arm 19 which is operated by rearward movement of the trip bar towards the support member. The switches 18 are connected in a control circuit with the motors 6 of the respective base and serve to de-energise these motors when they are operated.

Each of the links 16 is pivotally connected to the support member 11 by connection means 20 which can be releasably fastened to the support member anywhere along a part of its length so that the spacing of the pivot centres between the links and support member can be adjusted at will to match the position of the pivot centres between the links and the trip bar, thereby forming the necessary parallelogram configuration.

As illustrated in FIGS. 3 and 4, the connection means takes the form of clamp means comprising two plates 21, 22 which engage the support member 11 top and bottom and support a vertical pivot pin 23 therebetween which is welded to the link 16 at its lower end. A pair of bolts 24, 25 extends through both plates 21, 22 and are threaded in nuts 26 welded to the lower plate 21 so as to pull the plates together. The pivot pin 23 also extends through a spacer sleeve 27 which is positioned between the plates 21, 22 so as to hold them apart and prevent jamming of the pivot pin.

Each link 16 extends forwards of the support member 11 and is connected to the trip bar 15 at its outer end by a point pin 28 so that the trip bar lies below the support member 11 and can swing inwards beneath the latter. The coil spring 17 acts between a fixed stop 29 on the lower plate 21 of the clamp and the inner end of the link 16 beyond the pivot pin 23 so as to urge the inner end of the link against a fixed stop 30, in which position the trip bar extends forwards of the support member 11 to a maximum extent. The stop 30 therefore limits forward movement of the trip bar.

The stops 30 together, also serve facilitate longitudinal adjustment of the clamp means to form the necessary parallelogram configuration between the trip bar, the support member and the links. For this purpose, the stops 30 on clamp plates 21 are accurately positioned in the same fixed orientation relative to the respective pivot pins 23 so that the links 16 lie parallel to one another when their inner ends engage the respective stops 30. Thus, the spacing between the clamp means is adjusted until the links engage the stops 30. In doing this, one of the clamp means at one end of the trip bar may be fixed in a position with that end of the trip bar suitably aligned with the adjacent end of the base, and the other clamp means, whether there be one or more, may be adjusted longitudinally to bring the links into engagement with the stops. The position of said fixed clamp means may simply be judged by eye during assembly or may be predetermined and indicated by a mark or other positive locating means. For example, a hole may be provided in the support member and in the fixed clamp means and these may be brought into alignment and a split pin inserted through them both to key the clamp means in the correct position.

The electrical switch 18 is mounted on the lower clamp plate 21 and the operating arm 19 extends forwards to a position adjacent the rear face of the trip bar. In alternative embodiments, the switch 18 could be mounted anywhere along the trip bar 15 with the operating arm 19 arranged to be operated by engagement with a link 16 or a mobile member 11 or means fixed to the mobile member, or the switch 18 could even be mounted on a link 16 with the operating arm 19 arranged to be operated by engagement with the trip bar 15 or a mobile member 11 or means fixed to the mobile member.

The fact that the trip bar 15 is pivotally supported beneath the support member 11 by the links 16 is particularly important for a number of reasons. Firstly, the links are subject to a minimum of frictional forces and thus the trip bar responds to low operating forces which move it rearwardly. Secondly, the chances of any articles falling behind the trip bar and remaining there to block rearward movement are very slight. Thirdly, the vertical position of the trip bar can be adjusted and can be brought very close to ground level, thereby offering better protection for the feet of persons standing in the path of the base. As shown in the illustrated embodiment, the pivot pin 23 for each link can assume either of two vertical positions depending on whether or not the lower of two split pins 31 is inserted. In an alternative embodiment of the invention, the upper portion of each pivot pin 23 is threaded and a nut is provided on it so as to engage the upper clamp plate 22 and determine the vertical position of the link 16.

A further particularly advantageous feature of the illustrated ambodiment consists in the fact that the clamp plates 21, 22 both support the trip bar and carry the electrical switch 18. Nothing else associated with the trip bar is mounted on the support member 11 and the latter member is not modified in any special manner to carry the trip bar. The support member can therefore be used with either horizontal surface uppermost or on either side of the base and thereby simplifies manufacture by allowing the use of a single kind of support member on both sides of the base. For example, the support member in the illustrated embodiment is adapted for connection across two bays of the rack 2 by providing mounting plates 32, 33 and 34 on it at both ends and in the middle (see FIG. 2), whereby it can be bolted to the ends of the sections 8, one end mounting plate 32 and the central mounting plate 33 both extending across the full width of the end of sections 8 but the other end mounting plate 34 being of only half the width so that two support members can be arranged with the half plates abutting to make use of the full width of the end of a respective section 8.

The support members 11 take the preferred form of channel section members with the opening of the channel facing inwards to the base. This arrangement enables the member to be used to house electric cables 35 which are connected in the control circuit including the motors 6 and switches 18. These cables can be readily inserted and removed during installation and maintenance of the storage assembly. Preferably, the channel section support member 11 is of C-shaped section, it having a flange 36 on each side of the opening which projects inwards in the plane of the opening to help retain the cables within the support member. Further, a number of clips are preferably provided which can be removably secured across the opening so as to positively retain the cables in place. The cables may lie within the support members along the whole of their length or may pass round the connection means 20 and plates 33, 34 outside of the channel of the support member. In the former case the plates 33, 34 may each be formed in two parts on either side of the channel opening.

The trip bars 15 also take the preferred form of channel-section members with a relatively wide web. The channel section form of the trip bar makes it rigid and the wide webs of the channel section presents an extensive contact surface for obstructions.

In the alternative embodiment of the invention illustrated in FIG. 5, the trip bar 15 comprises a channel section portion which embraces the support member 11 and which is mounted on the support member by two pairs of parallel superimposed links 16' and 16''. Each pair of links comprises a lower link 16' which is mounted on the support member 11 by connection means similar to that shown in FIGS. 3 and 4, and an upper link 16'' which is connected to the top of pivot pin 23 at its upper end. The lower link 16' is pivotally connected at its outer end to the lower side flange 37 of the channel section portion of the trip bar 15, and the upper link 16'' is pivotally connected at its outer end to the upper side flange 38 of the channel section portion of the trip bar. Preferably, the trip bar 15 also has a downwardly projecting skirt 39 which stops just short of the ground. As illustrated in FIG. 5, the trip bar is formed from a single piece of sheet metal.

It will be apppreciated that although the invention has been described above in relation to its use in mobile storage assemblies, it can equally well be used in any other situation where it is required to stop a mobile member on contact with an object in its path of movement. For example, sensor means according to the invention can be applied to mobile vehicles and equipment such as hoists and order pickers, or to automatic doors and gates including lift doors.

We claim:

1. Sensor means which is fitted to a mobile member so as to stop the latter on engagement with an object in its path comprising a trip bar; a plurality of links which are arranged at spaced points along the length of the trip bar; a pivotal connection between one end of each link and the trip bar and a pivotal connection between the other end of each link and the mobile member; the pivotal axes of all of said pivotal connections extending parallel to one another and being spaced relative to one another so that the links, mobile member and trip bar form a folding parallelogram in which the trip bar is guided to move in a plane perpendicular to said pivotal axes; and switch means which is arranged in relation to said trip bar so as to be operated by movement of the latter towards said mobile member.

2. Sensor means as claimed in claim 1 in which the trip bar is connected to the mobile member by two longitudinally spaced links.

3. Sensor means as claimed in claim 1 in which at least one of the links is pivotally connected to the mobile member by connection means which is adjustable in position along a respective portion of the length of the mobile member.

4. Sensor means as claimed in claim 3 in which said connection means comprises a pair of clamp plates which engage opposite sides of the mobile member and a pivot pin supported therebetween, to which the respective link is connected.

5. Sensor means as claimed in claim 3 in which at least two of the links are pivotally connected to the mobile member by connection means, and in which at least two of the connection means each carry a stop which is arranged in a predetermined angular relation to the pivot centre between the respective link and connection means so that the links lie parallel to one another when they engage the respective stops.

6. Sensor means as claimed in claim 1 in which spring means is provided which urges the trip bar away from said mobile member to a forwardmost position defined by stop means.

7. Sensor means as claimed in claim 3 in which spring means is mounted on said connection means and urges the trip bar away from said mobile member to a forwardmost position defined by stop means.

8. Sensor means as claimed in claim 3 in which said switch means is mounted on said connection means.

9. Sensor means as claimed in claim 1 in which the trip bar and mobile member lie in different planes so that the trip bar cannot engage the mobile member as it moves.

10. Sensor means as claimed in claim 9 in which the mobile member and trip bar both extend substantially horizontally and the trip bar moves in a plane beneath the mobile member.

11. Sensor means as claimed in claim 10 in which the trip bar underlies the mobile member slightly in its forwardmost position.

12. Sensor means as claimed in claim 4 in which said respective link is connected to the lower end of said pivot pin and supports the trip bar in a plane beneath the mobile member.

13. Sensor means as claimed in claim 12 in which the pivot is vertically adjustable in height.

14. Sensor means as claimed in claim 1 in which the trip bar is connected to the mobile member by a plurality of pairs of parallel superimposed links which lie on opposite sides of the mobile member with the trip bar supported between them.

15. A mobile base for a storage unit of a storage assembly of the aforesaid kind and which is fitted with sensor means as claimed in claim 1, the mobile member being rigidly connected to the base so as to extend horizontally with the trip bar along a side of the base normal to its direction of movement.

16. A base as claimed in claim 15 in which the sensor means comprises a plurality of said trip bars which are mounted end-to-end along said side of the base.

17. A base as claimed in claim 15 in which said mobile member is a channel section member which is connected to the base with its opening facing inwards of the base to receive electrical cables of the control circuitry of the base.

18. A base as claimed in claim 15 in which the trip bar is a channel section member with the opening facing inwards of the base.

19. A storage assembly of the aforesaid kind which includes a plurality of mobile storage units each of which has a base as claimed in claim 15.

* * * * *